US005368970A

United States Patent [19]

Grushkin

[11] Patent Number: 5,368,970

[45] Date of Patent: Nov. 29, 1994

[54] TONER COMPOSITIONS WITH COMPATIBILIZER

[75] Inventor: Bernard Grushkin, Pittsford, N.Y.

[73] Assignee: Xerox Corporation, Stamford, Conn.

[21] Appl. No.: 165,422

[22] Filed: Dec. 6, 1993

[51] Int. Cl.[5] ..... G03G 9/087; G03G 9/097

[52] U.S. Cl. ..... 430/110; 430/109

[58] Field of Search ..... 430/110, 126

[56] References Cited

U.S. PATENT DOCUMENTS

| | | | |
|---|---|---|---|
| 4,367,275 | 1/1983 | Aoki et al. | 430/99 |
| 4,557,991 | 12/1985 | Takagiwa et al. | 430/109 |
| 4,795,689 | 1/1989 | Matsubara et al. | 430/99 |
| 4,997,739 | 3/1991 | Tomono et al. | 430/110 |
| 5,229,242 | 7/1993 | Mahabadi et al. | 430/106.6 |

*Primary Examiner*—Roland Martin

*Attorney, Agent, or Firm*—E. O. Palazzo

[57] ABSTRACT

A toner composition comprised of the reaction product of resin particles containing hydroxyl, or acid groups, and an alkylene-glycidyl methacrylate polymer; pigment particles, and a wax component.

25 Claims, No Drawings

TONER COMPOSITIONS WITH COMPATIBILIZER

BACKGROUND OF THE INVENTION

This invention is generally directed to toner and developer compositions, and more specifically the present invention is directed to toner compositions, including magnetic, single component, two component and colored toner compositions containing a wax component, In embodiments of the present invention, the toner is comprised of resin, especially a polyester resin, pigment, a wax component like polypropylene, or polyethylene, and the reaction product of an ethylene-glycidyl methacrylate copolymer with acid, or hydroxyl end groups, or mixtures thereof contained on the resin, which enables the grafted ethylene-glycidyl methacrylate copolymer to function as a compatibilizer and thus facilitate the dispersion of the wax as illustrated by the following

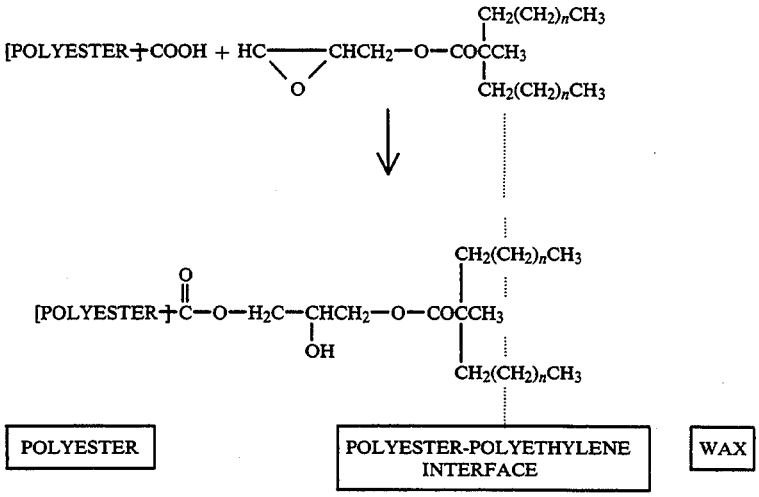

There is also provided in accordance with the present invention positively or negatively charged toner compositions comprised of polyester, pigment particles, a wax component, such as polypropylene wax, and a compatibilizer obtained by the reaction of the resin such as polyester acid end groups with an ethylene-glycidyl methacrylate copolymer, such as copolymers available from ELF Atochem North America Inc. as LOTADER ® AX8840, believed to be a polyethylene-glycidyl methacrylate copolymer, thereby permitting substantial permanent dispersion of the wax, or minimizing the amount of wax released from the toner. Free wax particles associated with that of the toner can cause filming on a magnetic roll and adversely affect the function of a magnetic brush. In monocomponent development, wherein a charge/metering blade is used, the magnetic donor roll can be filmed by the wax and cause slipping of toner behind the metering blade thereby reducing the amount of toner on the donor roll for development. There also is the potential for filming of the photoreceptor by the free wax and, in those situations wherein magnetic brush cleaners are used, filming also can occur. Furthermore, free wax particles can coat the carrier particles causing a change in the tribocharging properties, thereby reducing developer life. Also, when toner has been prepared with wax and the wax is poorly dispersed so as to generate free wax particles upon attrition to toner size, the fines collected by classification are rich in wax and may not be recyclable because their composition is different and not well controlled. These and other disadvantages are avoided or minimized with the toners and processes of the present invention.

The toner and developer compositions of the present invention are useful in a number of known electrostatographic imaging and printing systems. The toner compositions of the present invention in embodiments possess a wide fusing latitude, for example about 40° to 70° C., which is the temperature range between the minimum fixing temperature of, for example, from about 100° C. to about 180° C. required for fixing toner particles on paper and the hot offset temperature, for example, from about 150° C. to about 250° C. Further, the toner compositions of the present invention also provide toner images with low surface energy and a low frictional coefficient, which properties enable the effective release of paper from the fuser roll and provide for a reduction in image smudging. Moreover, the developer compositions of the present invention possess stable electrical properties for extended time periods, and with these compositions, for example, there is no substantial change in the triboelectrical charging values.

Toners with waxes, such as polypropylene and polyethylene, are known. One problem associated with some of these toners, especially when the toner resin is a polyester, is that the wax component releases from the toner and adversely effects the toner characteristics, such as the toner triboelectric characteristics. For example, there are illustrated in U.K. Patent Publication 1,442,835, the disclosure of which is totally incorporated herein by reference, toner compositions containing resin particles and polyalkylene compounds, such as polyethylene and polypropylene, of a molecular weight of from about 1,500 to about 20,000, reference page 3, lines 97 to 119, which compositions prevent toner offsetting in electrostatic imaging processes. Additionally, the '835 publication discloses the addition of paraffin waxes together with, or without a metal salt of a fatty acid, reference page 2, lines 55 to 58. Also, in U.S. Pat. No. 4,997,739, there is illustrated a toner formulation including polypropylene wax with a $M_w$ of from about 200 to about 6,000 to improve hot offset. In addition, many patents disclose the use of metal salts of fatty acids for incorporation into toner compositions, such as U.S. Pat. No. 3,655,374. Also, it is known that the aforementioned toner compositions with metal salts of fatty acids can be selected for electrostatic imaging methods wherein blade cleaning of the photoreceptor is accomplished, reference U.S. Pat. No. 3,635,704, the disclosure of which is totally incorporated herein by reference. Additionally, there are illustrated in U.S. Pat. No. 3,983,045 three component developer compositions comprising toner particles, a friction reducing material, and a finely divided nonsmearable abrasive material, reference column 4, beginning at line 31. Examples of friction reducing materials include saturated or unsaturated, substituted or unsubstituted, fatty acids preferably of from 8 to 35 carbon atoms, or metal salts of such fatty acids; fatty alcohols corresponding to said acids; mono and polyhydric alcohol esters of said acids and corresponding amides; polyethylene glycols and methoxy-polyethylene glycols; terephthalic acids; and the like, reference column 7, lines 13 to 43.

The following U.S. Pat. Nos. are mentioned: 4,795,689 which discloses an electrostatic image developing toner comprising as essential constituents a nonlinear polymer, a low melting polymer, which is incompatible with the nonlinear polymer, a copolymer composed of a segment polymer, which is at least compatible with the nonlinear polymer, and a segment polymer, which is at least compatible with the low melting polymer, and a coloring agent, see the Abstract, and columns 3 to 10 for example; 4,557,991 which discloses a toner for the development of electrostatic images comprised of a certain binder resin, and a wax comprising a polyolefin, see the Abstract; also, see columns 5 and 6 of this patent and note the disclosure that the modified component shows an affinity to the binder and is high in compatibility with the binder, column 6, line 25; and as collateral interest 3,965,021.

Described in U.S. Pat. No. 4,367,275 are methods of preventing offsetting of electrostatic images of the toner composition to the fuser roll, which toner subsequently offsets to supporting substrates, such as papers, wherein there are selected toner compositions containing specific external lubricants including various waxes, see column 5, lines 32 to 45.

However, there are various problems observed with the inclusion of polyolefins or waxes in toners. For example, when a polypropylene wax is included in a toner to enhance the release thereof from a hot fuser roll, or to improve the lubrication of a fixed toner image, it has been observed that the wax does not disperse well in the toner resin. As a result, free wax particles are released during the pulverizing step in, for example, a fluid energy mill. The poor dispersion of wax in the toner resin and, therefore, the loss of wax will then impair the release function it was designed for. Scratch marks, for example, on xerographic developed toner solid areas caused by stripper fingers have been observed as a result of the poor release. Furthermore, the free wax remaining in the developer can build up on the detone roll present in the xerographic apparatus causing a hardware failure.

All the problems mentioned above and others can be eliminated, or minimized with the toner compositions and processes of the present invention in embodiments thereof. The release of wax particles is, for example, a result of poor wax dispersion during the toner mechanical blending step. The toner additives should be well dispersed in the primary toner resin for them to impart their specific functions to the toner and thus the developer. For some of the additives, such as waxes like polypropylene, VISCOL 550P TM that become a separate molten phase during melt mixing, the difference in viscosity between the wax and the resin can be orders of magnitude apart, thus causing difficulty in reducing the wax phase domain size. Also, poor dispersion can be caused by the inherent thermodynamic incompatibility between polymers. The Flory-Huggins interaction parameter between the resin and the wax is usually positive (repulsive) and large thus interfacial energy remains very large in favor of phase separation into large domains to reduce interfacial area. Some degree of success has been obtained with regard to reducing free wax by mechanical blending the toner formulation in certain types of mixers, such as the known Banbury mixer and rubber mills, where the temperature of melt can be maintained at a low level and polymer viscosities are not that far apart, however, it is difficult to generate an effective wax dispersion in compounding extruders where melt temperatures are typically higher. Inclusion of the compatibilizer of the present invention is designed to overcome the inherent incompatibility between different polymers, and, more specifically, between toner resin and wax, thus widening the processing temperature latitude and enabling the toner preparation in a large variety of equipment, for example an extruder. Also, with the present invention the improvement in thermodynamic compatibility will provide for a more stable dispersion of secondary polymer phase, such as wax, in the host resin against gross phase separation over time.

Illustrated in U.S. Pat. No. 5,229,242 (D/91096), the disclosure of which is totally incorporated herein by reference, is a toner composition comprised of resin particles, pigment particles, wax component particles, and a compatibilizer; a toner composition comprised of first resin particles, second crosslinked resin particles, pigment, wax component particles, and a compatibilizer comprised of a graft copolymer, or a block copolymer; and a toner composition in accordance with claim 2 wherein the compatibilizer is of the formula A-b-B, A-b-B-b-A or A-g-B wherein A-b-B is a block copolymer of 2 segments; A and B, A-b-B-b-A is a block copolymer of 3 segments; and A-g-B is a graft copolymer of segments A and B.

In the present invention, the compatibilizing agent ethyleneglycidyl ester is reacted with the resin like a polyester and as such, will not interfere with the toner functionality, such as in fusing, wherein it is known that certain waxes with functional groups, for example oxidized waxes, can have an affinity for the fuser roll surface, coat surface thereof and shorten fuser life. In those situations wherein a block polymer is used as a compatibilizer, ideally, each segment needs to be specifically designed to be compatible with each phase for optimal performance. This may not always be feasible, particularly when a relatively low molecular weight polyester is the binder resin. In the present invention, the glycidyl ester reacts with the polyester end groups thereby grafting polyethylene onto the polyester, and one then need only be concerned with the polyethylene to compatibilize the wax.

A number of specific advantages are associated with the invention of the present application in embodiments thereof, including improving the dispersion of toner resin particles, especially a mixture of resins and wax; improving the dispersion of wax in the toner, thus eliminating the undesirable release of wax from the toner in the form of free wax particles during the pulverizing operation of the toner manufacturing process and the subsequent contamination of xerographic machine subsystems by these free wax particles; maintaining the intended concentration of wax in the toner to provide enhancement during release from the fuser roll and avoiding the undesirable scratch marks caused by the stripper fingers; a wide process latitude can be provided during the mechanical blending operation of the toner manufacturing process; enabling the effective mechanical blending of toner to be accomplished in a number of devices, including an extruder; prevention, or minimization of toner component interactions with charge additives, pigments, the fuser roll, improved toner and developer powder flow characteristics, and the like.

SUMMARY OF THE INVENTION

It is an object of the present invention to provide toner and developer compositions which possess many of the above noted advantages.

Another object of the present invention resides in the provision of toner and developer compositions with stable triboelectrical characteristics for extended time periods.

In another object of the present invention there are provided toner and developer compositions that enable improved dispersion of resin and wax components achievable in a number of devices, including an extruder.

Moreover, another object of the present invention relates to the provision of toner and developer compositions with a compatibilizer, and wherein for the resulting toners there is avoided, or there is minimized the undesirable generation of particles comprised entirely of a secondary polymer component during toner preparation.

In a further object of the present invention, the toner mechanical blending operation can be accomplished at a melt temperature as high as 50° C. above the melting point of the wax component, thus enabling for the preparation thereof the use of a large number of apparatuses in addition to a low melt temperature mixing process with a Banbury mixer.

In yet another object of the present invention, the secondary polymeric phases in the toner will remain stable and substantial phase separation, especially over extended time periods of, for example, up to three months in embodiments, will be avoided.

Additionally, in yet another object of the present invention there are provided toner and developer compositions with certain waxes therein or thereon that enable images of excellent quality inclusive of acceptable resolutions, and that possess other advantages as illustrated herein such as low surface energy.

Yet another object of the present invention resides in the provision of processes for the preparation of toner compositions wherein the undesirable escape of the wax contained therein is avoided or minimized.

Further, another object of the present invention resides in the use of commercially available ethylene-glycidal methacrylate copolymers as reactive compatibilizers to, for example, improve the dispersion of wax in toner resins, especially polyesters, and reactive extrusion processes thereof.

These and other objects of the present invention can be accomplished in embodiments by providing toner and developer compositions. More specifically, the present invention is directed to toner compositions comprised of the reaction product of the hydroxyl end groups or acid end groups contained on toner resin particles, especially polyesters, with an ethylene-glycidyl methacrylate copolymer; pigment particles; wax; and optional toner internal and external toner additives, such as charge additives, surface additives, and the like. In embodiments of the present invention, there are provided toner compositions comprised of the reaction product of the hydroxyl end groups of a polyester with an ethylene-glycidyl methacrylate copolymer; pigment; or dyes; low molecular weight waxes, such as polyethylene, and polypropylene, such as those available from Sanyo Chemicals of Japan as VISCOL 550P TM and VISCOL 660P TM, or mixtures thereof and the like. Furthermore, there are provided in accordance with the present invention either negatively or positively charged toner compositions comprised of modified or reacted resin, especially polyester particles; pigment particles; low molecular weight waxes; and a charge enhancing additives. Another embodiment of the present invention is directed to developer compositions comprised of the aforementioned toners, and carrier particles.

In addition, in accordance with embodiments of the present invention there are provided developer compositions comprised of toner compositions, pigment particles such as magnetites, carbon blacks or mixtures thereof, low molecular weight waxes, such as polyethylene, and polypropylene, such as those available from Sanyo Chemicals of Japan as VISCOL 550P TM and VISCOL 660P TM, and an optional charge enhancing additive, particularly, for example, distearyl dimethyl ammonium methyl sulfate, reference U.S. Pat. No. 4,560,635, the disclosure of which is totally incorporated herein by reference, and carrier particles. As carrier components for the aforementioned compositions, there can be selected a number of known materials like steel, iron, or ferrite, particularly with a polymeric coating thereover including the coatings as illustrated in U.S. Ser. No. 751,922. One coating illustrated in the aforementioned copending application is comprised of a copolymer of vinyl chloride and trifluorochloroethylene with conductive substances dispersed in the polymeric coating inclusive of, for example, carbon black. One embodiment disclosed in the aforementioned abandoned application is a developer composition comprised of styrene butadiene copolymer resin particles, and charge enhancing additives selected from the group consisting of alkyl pyridinium halides, ammonium sulfates, and organic sulfate or sulfonate compositions; and carrier particles comprised of a core with a coating of vinyl copolymers or vinyl homopolymers.

Illustrative examples of suitable toner resins selected for the toner and developer compositions of the present invention, and present in various effective amounts, such as, for example, from about 60 percent by weight to about 95 percent by weight, include primarily polyesters, such as those illustrated, for example, in U.S. Pat. No. 3,590,000, U.S. Pat. No. 5,227,460 (D/91117Q) and copending application U.S. Ser. No. 814,64 (D/91117), the disclosures of which are each totally incorporated herein by reference. Other suitable resins providing they are modified to contain the appropriate end groups, that is for example by effecting compolymerization thereof with stearic acid or hydroxy containing monomer include polyester resins obtained from the reaction of bisphenol A and propylene oxide, followed by the reaction of the resulting product with fumaric acid; and branched polyester resins resulting from the reaction of dimethylterephthalate, 1,3-butanediol, 1,2-propanediol and pentaerythritol, polyamides, polyesteramides, and polyimides.

Especially preferred are the polyesters as illustrated in copending patent applications U.S. Ser. No. 814,641 (D/91117), and U.S. Pat. No. 5,227,460 (D/91117Q), the disclosures of which are totally incorporated herein by reference.

Numerous well known suitable pigments can be selected as the colorant for the toner including, for example, carbon black like REGAL 330®, BLACK PEARLS®, VULCAN®, and the like, nigrosine dye, aniline blue, phthalocyanine derivatives, magnetites and mixtures thereof. The pigment, which is preferably carbon black, should be present in a sufficient amount to render the toner composition colored thereby permitting the formation of a clearly visible image. Generally, the pigment particles are present in amounts of from about 1 percent by weight to about 20 percent by weight, and preferably from about 5 to about 10 weight percent, based on the total weight of the toner composition, however, lesser or greater amounts of pigment particles may be selected in embodiments.

When the pigment particles are comprised of known magnetites, including those commercially available as MAPICO BLACK®, they are usually present in the toner composition in an amount of from about 10 percent by weight to about 70 percent by weight, and preferably in an amount of from about 10 percent by weight to about 30 percent by weight. Alternatively, there can be selected as pigment particles mixtures of carbon black or equivalent pigments and magnetites, which mixtures, for example, contain from about 6 percent to about 70 percent by weight of magnetite, and from about 2 percent to about 15 percent by weight of carbon black.

In another embodiment of the present invention there are provided colored toner compositions containing as pigments or colorants known magenta, cyan, and/or yellow particles, as well as mixtures thereof. More specifically, with regard to the generation of color images utilizing the toner and developer compositions of the present invention, illustrative examples of magenta materials that may be selected include, for example, 2,9-dimethyl-substituted quinacridone and anthraquinone dye identified in the Color Index as CI 60710, CI Dispersed Red 15, a diazo dye identified in the Color Index as CI 26050, CI Solvent Red 10, LITHOL SCARLETT TM, HOSTAPERM TM, and the like. Illustrative examples of cyan materials that may be used as pigments include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, Sudan Blue, and the like; while illustrative examples of yellow pigments that may be selected include diarylide yellow 3,3-dichlorobenzidene acetoacetanilides, a monazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, Permanent Yellow FGL, and the like. Also, there may be selected red, green, blue, brown, and the like pigments. These pigments are generally present in the toner composition in an amount of from about 2 weight percent to about 15 weight percent, and preferably from about 2 to about 10 weight percent, based on the weight of the toner resin particles.

Examples of low molecular weight, for example from about 1,000 to about 20,000, and preferably from about 1,000 to about 7,000, waxes include those as illustrated in the British Patent Publication 1,442,835 mentioned herein, such as polyethylene, polypropylene, and the like, especially VISCOL 550P TM and VISCOL 660P TM. The aforementioned waxes, which can be obtained in many instances from Sanyo Chemicals of Japan, are present in the toner in various effective amounts, such as for example from about 0.5 to about 10, and preferably from about 3 to about 7 weight percent. Examples of functions of the wax are to enhance the release of paper after fusing, and providing the fused toner image with lubrication. The release or separation of wax from the toner can reduce these functions. Also, toners with poor wax dispersion have a lower pulverizing rate and the free wax which can remain with the toner will build up on the internal parts of the xerographic cleaning device causing a machine failure.

Examples of copolymers that can be reacted with the toner resin like polyesters, include ethylene-glycidyl methacrylate ester, LOTADER AX8840 TM, available from ELF ATOCHEM, NA, Inc, containing 8 weight percent of glycidyl ester which was particularly effective as a wax dispersant when melt mixed with a polyester comprised of the reaction products of propoxylated bisphenol A and fumaric acid which had been cross-linked with benzoyl peroxide thereby forming thirty weight percent of gel. The reaction product of polyester and 0.5 to 5.0 weight percent and preferably, 1.0 to 3.0 weight percent LOTODAR AX8840 TM can be accomplished in a Werner Pfleiderer extruder in the presence of aforementioned waxes, pigment, and optional, charge enhancing additive. Extrusion set temperatures were adjusted so that the exiting extrudate had a temperature from 115° C. to 160° C. When VISCOL 660P TM was used, the preferred temperature was from about 138° C. to about 150° C. When crystalline polyethylene, such as POLYWAX 1000 TM available from PETROLITE Corporation, was used, the extruder set temperatures were adjusted to provide an extrudate exiting the extruder with a temperature of 100° C. to 120° C.

In another embodiment of the present invention, LOTADER AX8840 and the reaction product of propoxylated bisphenol A and fumaric acid were extruded in the presence of 0.3 to 1.5 weight percent of benzoyl peroxide at a temperature of 140° to 180° C. The extrudate was then re-extruded with wax, pigment, and charge enhancing agent, after which it was converted to toner by attrition.

Alternatively, LOTADER AX8840 TM and wax were melt mixed as a master batch with ratios of 1:1 to 10:1, then re-extruded with polyester, pigment, and additional wax. In this situation, constituent ratios can be adjusted in a manner that the LOTADER AX8840 TM is present in an amount from 0.2 to 10 percent, and preferably from 1 to 4 weight percent, and the wax is present in an amount from 2 to 10 weight percent, and preferably from 3 to 7 weight percent. After melt mixing by extrusion, micronization and classification to a volume average size of 7 to 10 micrometers toner was examined by optical microscopy at 400×magnification with crossed polarizers and found to contain no free wax as would have been evident by the appearance of birefringant particles.

Illustrative examples of optional charge enhancing additives present in various effective amounts, such as for example from about 0.1 to about 20, and preferably from 1 to about 5 weight percent by weight, include alkyl pyridinium halides, such as cetyl pyridinium chlorides, reference U.S. Pat. No. 4,298,672, the disclosure of which is totally incorporated herein by reference, cetyl pyridinium tetrafluoroborates, quaternary ammonium sulfate, and sulfonate charge control agents as illustrated in U.S. Pat. No. 4,338,390, the disclosure of which is totally incorporated herein by reference; stearyl phenethyl dimethyl ammonium tosylates, reference U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; stearyl dimethyl hydrogen ammonium tosylate; distearyl dimethyl ammonium bisulfates, inner ammonium salts, negative charge additives such as aluminum complexes, such as BONTRON E-88 TM, reference U.S. Pat. No. 4,845,003, and other known similar charge enhancing additives; and the like.

With further respect to the toner and developer compositions of the present invention, especially when the compatibilizer, linear polyester and free radical initiator are first extruded, a component that may be present therein is the linear polymeric alcohol comprised of a fully saturated hydrocarbon backbone with at least about 80 percent of the polymeric chains terminated at one chain end with a hydroxyl group, which alcohol is represented by the following formula $$CH_3(CH_2)_nCH_2OH$$

wherein n is a number of from about 30 to about 300, and preferably of from about 30 to about 100, which alcohols are available from Petrolite Corporation. Particularly preferred polymeric alcohols include those wherein n represents a number of from about 30 to about 50. Therefore, in a preferred embodiment of the present invention the polymeric alcohols selected have a number average molecular weight as determined by gas chromatography of from about greater than 450 to about 1,400, and preferably of from about 475 to about 750. In addition, the aforementioned polymeric alcohols can be present in the toner and developer compositions illustrated herein in various effective amounts, and can be added as uniformly dispersed internal, or as finely divided uniformly dispersed external additives. More specifically, the polymeric alcohols can be present in an amount of from about 0.05 percent to about 10 percent by weight. Therefore, for example, as internal additives the polymeric alcohols are present in an amount of from about 0.5 percent by weight to about 20 percent by weight, while as external additives the polymeric alcohols are present in an amount of from about 0.05 percent by weight to slightly less than about 5 percent by weight. Toner and developer compositions with the waxes present internally are formulated by initially blending the toner resin particles, pigment particles, and polymeric alcohols, and other optional components. In contrast, when the polymeric alcohols are present as external additives, the toner composition is initially formulated comprised of, for example, resin particles and pigment particles; and subsequently there is added thereto finely divided polymeric alcohols.

Illustrative examples of carrier particles that can be selected for mixing with the toner compositions of the present invention include those particles that are capable of triboelectrically obtaining a charge of opposite polarity to that of the toner particles. Accordingly, the carrier particles can be selected so as to be of a negative polarity thereby enabling the toner particles which are positively charged to adhere to and surround the carrier particles. Alternatively, there can be selected carrier particles with a positive polarity enabling toner compositions with a negative polarity. Illustrative examples of known carrier particles that may be selected include granular zircon, granular silicon, glass, steel, nickel, iron, ferrites like copper zinc ferrites, available from Steward Chemicals, and the like. The carrier particles may include thereon known coatings like fluoropolymers, such as KYNAR ®, polymethylacrylate, and the like. Examples of specific coatings that may be selected include a vinyl chloride/trifluorochloroethylene copolymer, which coating contains therein conductive particles, such as carbon black. Other coatings include fluoropolymers, such as polyvinylidene fluoride resins, poly(chlorotrifluoroethylene), fluorinated ethylene and propylene copolymers, terpolymers of styrene, methylmethacrylate, and a silane, such as triethoxy silane, reference U.S. Pat. Nos. 3,467,634 and 3,526,533, the disclosures of which are totally incorporated herein by reference; polytetrafluoroethylene, fluorine containing polyacrylates, and polymethacrylates; copolymers of vinyl chloride, and trichlorofluoroethylene; and other known coatings. There can also be selected as carriers components comprised of a core with a mixture, especially two polymer coatings thereover, reference U.S. Pat. Nos. 4,937,166 and 4,935,326, the disclosures of which are totally incorporated herein by reference.

Also, while the diameter of the carrier particles can vary, generally they are of a diameter of from about 50 microns to about 1,000 microns, and preferably from about 65 to about 200 microns, thus allowing these particles to, for example, possess sufficient density and inertia to avoid adherence to the electrostatic images during the development process. The carrier particles can be mixed with the toner particles in various suitable combinations, such as from about 1 to about 3 parts per toner to about 100 parts to about 200 parts by weight of carrier.

The toner compositions of the present invention can be prepared by a number of known methods, including blending and melt blending the reacted toner resin particles, pigment particles or colorants, and optional additives, followed by mechanical attrition including classification. The toner particles are usually pulverized and classified., thereby providing a toner with an average volume particle diameter of from about 7 to about 25, and preferably from about 10 to about 15 microns as determined by a Coulter Counter. The toner compositions of the present invention are particularly suitable for preparation in a compounding extruder such as a corotating intermeshing twin screw extruder of the type supplied by the Werner & Pfleiderer Company of Ramsey, N.J. The advantage of including a compatibilizer may not be limited to the mechanical blending process; thus, for example, improved dispersion and adhesion can be realized in other known preparation methods, such as a Banbury rubber mill by using the toner compositions of the present invention.

The toner and developer compositions of the present invention may be selected for use in developing images in electrostatographic imaging systems containing therein, for example, conventional photoreceptors, such as selenium and selenium alloys. Also useful, especially wherein there are selected positively charged toner compositions, are layered photoresponsive devices comprised of transport layers and photogenerating layers, reference U.S. Pat. Nos. 4,265,990; 4,585,884; 4,584,253 and 4,563,408, the disclosures of which are totally incorporated herein by reference, and other similar layered photoresponsive devices. Examples of photogenerating layers include selenium, selenium alloys, trigonal selenium, metal phthalocyanines, metal free phthalocyanines, titanyl phthalocyanines, and vanadyl phthalocyanines, while examples of charge transport layers include the aryl amines as disclosed in U.S. Pat. No. 4,265,990, the disclosure of which is totally incorporated herein by reference. Moreover, there can be selected as photoconductors hydrogenated amorphous silicon, and as photogenerating pigments squaraines, perylenes, and the like.

The toner and developer compositions of the present invention can be particularly useful with electrostatographic imaging apparatuses containing a development zone situated between a charge transporting means and a metering charging means, which apparatus is illustrated in U.S. Pat. Nos. 4,394,429 and 4,368,970. More specifically, there is illustrated in the aforementioned '429 patent a self-agitated, two-component, insulative development process and apparatus wherein toner is made continuously available immediately adjacent to a flexible deflected imaging surface, and toner particles transfer from one layer of carrier particles to another layer of carrier particles in a development zone.

The following Examples are provided, wherein parts and percentages are by weight unless otherwise indicated. A Comparative Example is also provided.

COMPARATIVE EXAMPLE 1

A toner composition comprised of 89 percent by weight of the aforementioned reacted polyester resin comprised of the condensation product of propoxylated bisphenol A and fumaric acid that has been crosslinked with benzoyl peroxide to form a 30 percent by weight gel, reference U.S. Pat. No. 5,227,460 and U.S. Ser. No. 814,641, the disclosures of which are totally incorporated herein by reference, 4 percent by weight of the polypropylene wax VISCOL 660P TM, available from Sanyo Chemicals of Japan, 6 percent by weight of REGAL 330 ® carbon black was prepared by mechanically blending the aforementioned components using a Werner & Pfleiderer ZSK-40 twin screw extruder at barrel set temperatures ranging from 90° to 140° C. After pulverization and classification, toner particles with volume average diameter of about 9 microns as measured by a Coulter Counter were obtained. The percent by weight of the free wax particles was determined to be 0.6. The free wax particles did not contain carbon black and, therefore, were lighter than the normal toner particles. A centrifugal separation technique based on the difference in specific gravity was then used to separate the lighter wax particles and determine their percent by weight. Transmission electron microscope analysis of the above toner evidenced that domains of wax were about 2 to 4 microns, the longest projected dimension measured on a TEM photomicrograph. Differential scanning calorimetry (DSC) was used to quantify the amount of wax in the toner. In this toner, the wax content was determined to be 2.5 percent by weight of the toner. Analysis by DSC of the toner fines collected by classification of the toner had 5.5 percent by weight of wax, thus partially accounting for the reduced amount of wax in the classified toner.

Subsequently, there was prepared a developer composition by admixing the aforementioned formulated toner composition mechanically blended in an extruder at 130° C. at a 4.5 percent toner concentration, that is 4.5 parts by weight of toner per 100 parts by weight of carrier with carrier comprised of a steel core with a coating, 0.8 weight percent thereover of a polyvinylidine flouride, and polymethyl methacrylate 60/40. Thereafter, the formulated developer composition was incorporated into an electrostatographic imaging device with a toner transporting means, a toner metering charging means, and a development zone as illustrated in U.S. Pat. No. 4,394,429. After less than 1,000 copies, defects of print quality were noted which were attributed to the fused image failing to properly release from the fusing roll.

EXAMPLE I

A toner was prepared by repeating the procedure of Comparative Example 1 with the exception that LOTADER AX8840 TM in an amount of 4 percent by weight was incorporated into the toner during melt blending in the extruder. After micronization by air attrition and classification, the 9.5 micron toner was found to contain 0.1 percent by weight of free wax particles. DSC analysis of the toner for total wax content indicated that the toner contained 3.7 weight percent.

Subsequently, there was prepared a developer composition by admixing the aforementioned formulated toner composition with carrier at 4.5 percent toner concentration. The prepared developer composition was then incorporated into the same electrostatographic imaging device of Comparative Example 1, and a test run of 20,000 copies was accomplished. The copy quality for the developed images was excellent throughout the test. The paper was released easily after fusing and no scratching was caused by stripper fingers on developed solid areas as determined by visual examination.

EXAMPLE II

A toner was prepared by repeating the procedure of Example I with the exception that 3 percent by weight of LOTADER AX8840 TM and 3 percent by weight of VISCOL 660P TM were melt blended in the ZSK-40 extruder with 6 weight percent of REGAL 330 ® carbon black. The extrudate was micronized and classified to an average size of 9.8 microns by volume. No free wax particles were detected and total wax content, as measured by DSC analysis, was 4.0 percent by weight of toner. TEM examination of the toner indicated that the wax domains were generally less than one micron in the longest dimension.

Subsequent testing of the toner by preparation of a developer comprised of 4.5 parts toner and 100 parts carrier provided results comparable to that of Example I; copy quality for the developed images was excellent, and the paper was released easily after fusing. No scratching was caused by stripper fingers on developed solid areas as determined visual examination.

EXAMPLE III

In another embodiment, 2 parts of LOTADER AX8840 TM and 100 parts of the linear unsaturated polyester reaction product of propoxylated bisphenol A and fumaric acid were melt mixed in ZSK-40 extruder in the presence of 0.9 part of benzoyl peroxide at a melt temperature of 160° C. This product then was ground to a moderately fine powder of 500 microns; using a Fitzmill and the melt blended with 5 parts of REGAL 330 ® carbon black and 4 parts of VISCOL 660P TM wax. The resultant toner extrudate then micronized and classified to 9.5 micron average volume diameter. There was found to be 0.2 percent by weight of free wax particles and a total wax content of 3.9 weight percent. In a subsequent Xerox Corporation 5090 machine test, developer prepared with this toner provided excellent copy quality and no scratching as caused by stripper fingers was evident as determined by visual examination of fused solid areas on the copy.

EXAMPLE IV

In a ZSK-53 extruder, a blend of 60 parts of LOTADER AX8840 TM and 40 parts of VISCOL 660P TM were melt blended at 170° C. Seven parts of this extrudate were then mixed with 5 parts of REGAL 330 ® carbon black, 1.2 parts of VISCOL 660P TM and 86.8 parts of the reaction product of propoxylated bisphenol A and fumaric acid, which had been crosslinked with benzoyl peroxide to yield a polyester with 30 weight percent gel, reference the polyester of Comparative Example 1. The extrudate was then micronized and classified to yield a toner with an 8.9 micron average volume diameter. Analysis of the toner yielded 0.05 weight percent of free wax particles. The toner had a total wax content of 3.9 weight percent as based on DSC analysis.

Other modifications of the present invention may occur to those skilled in the art subsequent to a review of the present application. The aforementioned modifications, including equivalents thereof, are intended to be included within the scope of the present invention.

What is claimed is:

1. A toner composition comprised of the reaction product of resin particles containing hydroxyl, or acid groups, and an alkylene-glycidyl methacrylate polymer; pigment particles, and a wax component.

2. A toner composition comprised of the reaction product of a polyester containing acid, or hydroxyl groups, and an alkylene-glycidyl methacrylate polymer; pigment, and a wax component.

3. A toner composition in accordance with claim 2 wherein the polymer is an ethylene glycidyl methacrylate copolymer with from about 3 to about 20 percent of glycidyl methacrylate and preferably from about 6 to about 10 percent of glycidyl methacrylate.

4. A toner composition in accordance with claim 2 wherein the polymer is a polyethylene-glycidyl methacryate.

5. A toner composition in accordance with claim 1 wherein the resin particles are selected from the group consisting of polyesters, polyamides, polyester-amides, and polyimides.

6. A toner composition in accordance with claim 2 wherein the polyester results from the condensation reaction of dimethylterephthalate, 1,2-propanediol, 1,3-butanediol, and pentaerythritol; or wherein the polyester results from the condensation reaction of dimethylterephthalate, 1,2-propanediol, diethylene glycol, and pentaerythritol.

7. A toner composition in accordance with claim 2 wherein the pigment is carbon black, magnetite, or mixtures thereof.

8. A toner composition in accordance with claim 2 wherein the pigment is selected from the group consisting of magenta, cyan, yellow, and mixtures thereof.

9. A toner composition in accordance with claim 2 wherein the wax has a weight average molecular weight of from about 1,000 to about 10,000.

10. A toner composition in accordance with claim 1 wherein the wax is a polyolefin, or mixture of polyolefins.

11. A toner composition in accordance with claim 10 wherein the polyolefin is polyethylene or polypropylene.

12. A toner composition in accordance with claim 2 wherein the wax is a polyolefin, or mixture of polyolefins comprised of polyethylene and polypropylene.

13. A toner composition in accordance with claim 2 wherein the wax is present in an amount of from about 1 to about 10 weight percent.

14. A toner composition in accordance with claim 2 wherein the wax is present in an amount of from about 2 to about 7 weight percent.

15. A toner composition in accordance with claim 2 containing a charge enhancing additive selected from the group consisting of distearyl dimethyl ammonium methyl sulfate, acetyl pyridinium halide, and stearyl phenethyl dimethyl ammonium tosylate.

16. A toner composition in accordance with claim 2 wherein negative charge enhancing additives are present.

17. A toner composition in accordance with claim 2 wherein the polyester resin is the reaction product of propoxylated bisphenol A fumaric acid which has been crosslinked with peroxide to form from about 5 to about 40 weight percent of gel.

18. A toner composition in accordance with claim 2 wherein the reaction is accomplished by melt mixing at between about 110° C. and about 200° C., and preferably from about 140° C. to about 180° C.

19. A developer composition comprised of the toner composition of claim 1, and carrier particles.

20. A developer composition comprised of the toner composition of claim 2, and carrier particles.

21. A developer composition in accordance with claim 20 wherein the carrier particles are comprised of a core with a polymeric coating thereover.

22. A developer composition in accordance with claim 20 wherein the carrier particles are comprised of a core with a mixture of polymeric coatings thereover.

23. A developer composition in accordance with claim 22 wherein the carrier particles are comprised of a steel or a ferrite core with a coating thereover selected from the group consisting of polychlorotrifluoroethylene-co-vinylchloride copolymer, a polyvinylidene fluoropolymer, a terpolymer of styrene, methacrylate, and an organo silane, fluorinated ethylene-propylene copolymers, and polytetrafluoroethylene.

24. A method for obtaining images which comprises generating an electrostatic latent image on a photoconductive imaging member, subsequently affecting development of this image with the toner composition of claim 1, thereafter transferring the image to a permanent substrate, and optionally permanently affixing the image thereto.

25. A method for obtaining images which comprises generating an electrostatic latent image on a layered photoconductive imaging member, subsequently affecting development of this image with the toner composition of claim 2, thereafter transferring the image to a permanent substrate, and optionally permanently affixing the image thereto.

* * * * *